United States Patent [19]

Buckle

[11] Patent Number: 4,498,881

[45] Date of Patent: Feb. 12, 1985

[54] INFLATABLE ARTICLES

[75] Inventor: Brain L. Buckle, Colwyn Bay, Wales

[73] Assignee: E. C. Hopkins Limited, West Midlands, England

[21] Appl. No.: 302,702

[22] Filed: Sep. 16, 1981

[30] Foreign Application Priority Data

Sep. 16, 1980 [GB] United Kingdom ..... 8029827
Mar. 16, 1981 [GB] United Kingdom ..... 8108132

[51] Int. Cl.[3] ..... B63C 9/12
[52] U.S. Cl. ..... 441/93
[58] Field of Search ..... 441/7, 10, 28, 30, 31, 441/33, 40, 41, 42, 90, 92, 93, 96, 98, 101; 114/317

[56] References Cited

U.S. PATENT DOCUMENTS 2,687,541 8/1954 Bannister ..... 441/10
2,994,892 8/1961 Paradis ..... 441/10

FOREIGN PATENT DOCUMENTS 718674 9/1965 Canada ..... 441/93

*Primary Examiner*—Sherman D. Basinger
*Assistant Examiner*—Jesûs D. Sotelo
*Attorney, Agent, or Firm*—Oblon, Fisher, Spivak, McClelland & Maier

[57] ABSTRACT

An inflatable article adapted for automatic inflation, for example a life jacket, an inflatable suit, or a life raft. The article has a compressed gas cylinder for inflating the article with a gas, and a diaphragm for comparing the ambient fluid pressure with the internal gas pressure in a closed flexible compartment such as the internal space of the article and for activating the article automatically when the ambient fluid pressure exceeds by a predetermined amount the internal gas pressure in the compartment.

15 Claims, 3 Drawing Figures

INFLATABLE ARTICLES

The present invention relates to inflatable articles and provides a control device for automatically actuating inflation of an inflatable article incorporating the device. The invention has particular, but not exclusive, application to life jackets, life rafts and other inflatable marine survival apparatus.

Inflatable marine survival apparatus such as life jackets, life rafts and air crew survival suits usually incorporate a control device for automatically actuating inflation when the apparatus is immersed in water. Said device includes a disc of water-absorbent material, usually paper, which when dry retains a spring-loaded pin against its spring bias. When the apparatus is immersed in water, the disc is wetted by the water and, on becoming damp, loses strength. The damp disc is no longer able to retain the pin against its spring bias and hence the pin penetrates the disc and pierces the operculum of a compressed gas cylinder or otherwise operates to commence inflation of the apparatus.

Unfortunately, said disc-containing control devices are not untirely satisfactory. In particular, they are susceptible to accidental operation resulting from ambient dampness in the area in which they are stored. The accidental inflation of life jackets is a continual source of inconvenience to airlines who are obliged to carry on each aircraft flight sufficient life jackets for a full complement of passengers.

An object of the present invention is to provide a reliable control device for automatically actuating inflation of inflatable marine survival apparatus, especially life jackets.

A further object of the invention is to provide an inflation control device which does not rely for its operation upon the absorbtion of water by a water-absorbent material.

According to one aspect of the present invention, there is provided an inflatable article adapted for automatic inflation, including means for inflating the article with a gas and means for comparing the ambient fluid pressure with the internal gas pressure in a closed flexible compartment and for activating the said inflation means automatically when the ambient fluid pressure exceeds by a predetermined amount the internal gas pressure in the said compartment.

In a second aspect of the invention, there is provided a control device for automatically actuating inflation means to inflate an inflatable article with gas, said control device comprising pressure sensing means monitoring the difference in pressure between the ambient fluid and gas within a closed flexible compartment and providing a control signal when the ambient fluid pressure exceeds by a predetermined amount the gas pressure in the said compartment and actuating means responsive to the said signal to actuate the inflation means.

The said flexible compartment is preferably the internal space of the inflatable article.

The apparatus has general application to inflatable articles which might be required to automatically inflate in response to an increase in ambient fluid pressure. However, as mentioned previously, the invention has particular application to inflatable marine survival apparatus. Accordingly, the said inflatable article of the invention preferably is a life jacket, life raft, air crew survival suit or other inflatable articles intended for marine survival. It is particularly preferred that the inflatable article of the invention is a life jacket.

Conveniently, the pressure sensing means comprises a diaphragm which is exposed at one surface to the ambient fluid and at the other surface to the internal gas. Preferably the diaphragm is located in a housing connected to a wall of the inflatable article and having respective orifices communicating directly with the ambient fluid and internal gas.

When the pressure sensing means comprises a diaphragm as discussed above, the actuating means suitably comprises a rigid operating member extending from and movable with the diaphragm. This operating member can operate directly upon switching means to actuate the inflation means. The switching means can be electrical, hydraulic, mechanical or pneumatic depending upon the nature of the inflation means. Where, as in the case of relatively small inflatable articles such as life jackets, the inflation means is provided by a compressed gas cylinder, said switching means can operate to release a spring-loaded pin to move under the spring bias to pierce the operculum of the cylinder.

It is presently preferred that the said switching means is pneumatic and, in general, that the actuating means should include pneumatic switching means. In particular, it is preferred that the control device comprises a compressed gas, especially air, reservoir from which gas is released by a valve operated in response to the control signal from the pressure sensing means. The gas thus released can actuate further switching means to finally actuate the inflation means. However, it is presently preferred that the drop in gas pressure within the reservoir actuates such further switching means. In particular it is preferred that the gas pressure in the reservoir normally acts upon a spring-loaded piston to retain the piston against its spring bias. The piston can carry a pin aligned with the operculum of a compressed gas cylinder whereby a release of gas pressure in the reservoir permits the piston to move in response to the spring-bias to cause the pin to pierce the operculum.

The following is a description, by way of example only and with reference to the accompanying drawings, of a presently preferred embodiment of the invention. In the drawings.

Figure 1:
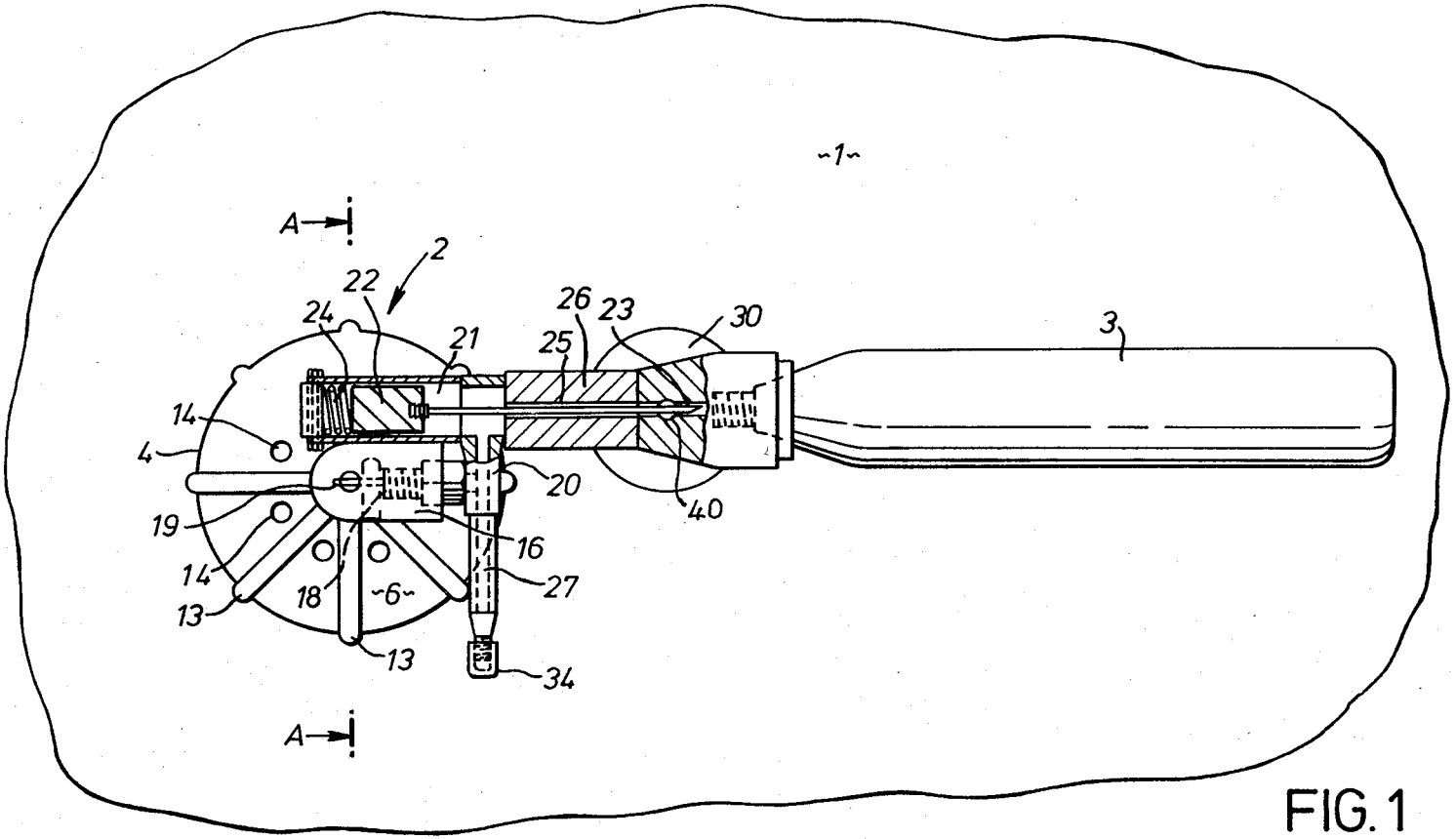
FIG. 1 is an elevation of part of a life jacket, carrying a control valve of the invention and a compressed gas cylinder.

Referring to the drawings, an inflatable life jacket 1 is provided with a control device 2 for automatically actuating inflation of the life jacket with gas (normally carbon dioxide or compressed air) stored in a compressed gas cylinder 3. The control device 2 comprises a housing 4 comprising a base 5 and a cap 6 which is threadibly received on the base 5. The base and cap 5,6 clamp the edges of a diaphragm 7 which extends across a cavity 8 defined between the base 5 and cap 6.

The base 5 is provided with a central bore which is threaded at its outer end to receive an air inlet pipe 9. The pipe 9 passes through an orifice in a wall 10 of the life jacket 1 and is provided with an annular flange 11 to clamp the wall 10 against the bottom of the base 5. The distal end of the air inlet pipe 9 is closed but there is provided adjacent that end a plurality of circumferentially spaced radially extending ports 12 to permit air to pass through the pipe.

The cap 6 is provided with a number of radially extending reinforcing ribs 13. A number of ports 14 for ambient fluid are provided in the cap 6. These ports 14 permit ambient fluid to contact the outer surface of the diaphragm 7 whilst the ports 12 permit air within the life jacket to contact the inner surface of the diaphragm 7. Accordingly, the diaphragm moves in response to differences in pressure between the ambient fluid and the air inside the life jacket.

Figure 2:
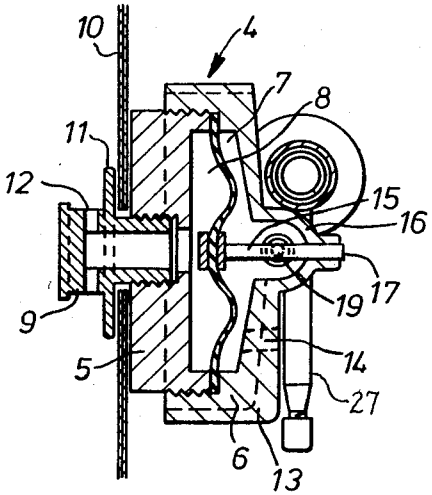
FIG. 2 is a section on the line AA of FIG. 1.
Figure 3:
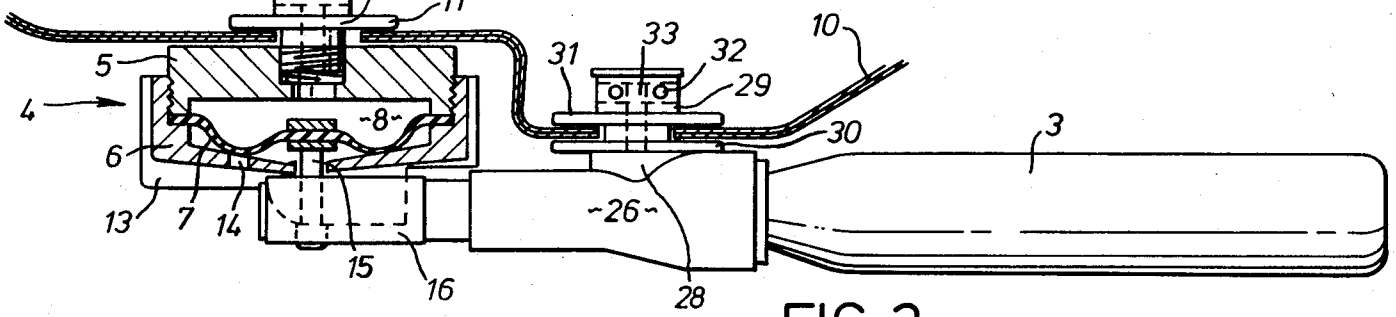
FIG. 3 is a plan view, partly in section, corresponding to FIG. 1.

The diaphragm 7 carries a central stem 15 which extends through the cap 6 into a valve housing 16 mounted on the cap. As shown in FIG. 2, the valve housing 16 is open to the ambient fluid via a bore 17 which also serves to admit ambient fluid into the cap 6. However, it is anticipated that the bore 17 will be blanked off in production versions of the control device. The housing 16 contains a so-called whisker valve 18 (shown in FIG. 1) having an operating lever 19. The valve is normally in a closed position but is opened by tilting the lever 19 from its normal position against spring bias. The lever 19 is located in an elongate slot (not shown) which extends axially in the stem 15.

The valve 18 controls flow of air from a manifold 20 extending from a cylinder (i.e. reservoir) 21. A piston 22 is slidably received in the cylinder 21 and carries an axially extending pin 23. The piston 22 is biased in the direction of the pin 23 by a spring 24 which acts between the piston and the base of the cylinder 21.

The pin 23 passes through a bore 25 in a gas cylinder holder 26 which otherwise closes the forward end of the cylinder 21. Air is prevented from passing through the bore 25 about the pin 23 by O-rings 40 (only one of which is shown) located at each end of the bore 25. The neck of the compressed gas cylinder 3 is threadibly received in a cooperating recess at the forward end of the holder 26 so that, when the piston 22 is in its forward position, the pin 25 extends through the operculum which normally closes the neck of the gas cylinder. However, the gas cylinder 3 is not screwed into the holder 26 until the piston 22 and pin 23 are pneumatically retained in a rearward position (see below).

The manifold 20 is connected to an air inlet valve 27 of the kind used for bicycle or motor car tires. Air admitted through the valve passes into the cylinder 21 and, as the air pressure in the cylinder increases, the piston 22 is forced rearwardly against the bias of spring 24 into a retracted position. In this position of the piston 22, the pin 23 is sufficiently retracted that the compressed gas cylinder 3 can be screwed into the holder 28 without the pin piercing the operculum.

The holder 26 has a lateral gas outlet 28 which threadibly receives an outlet pipe 29 passing through an orifice in the wall 10 of the life jacket 1. The outlet 28 and outlet pipe 29 are provided with respective annular flanges 30, 31 clamping the wall 10 between them. The distal end of the outlet pipe 29 is closed but circumferentially spaced radially extending outlet ports 32 are provided in the pipe 29 for egress of gas. A broad elastic band 33 extends circumferentially around the pipe 29 covering the ports 32 and thereby constituting a simple one way valve.

In use, the valve 27 is connected to a hand or foot pump or compressed air supply line and air charged to the cylinder 21 via the manifold 20. The supply of air is continued until sufficient pressure has built up in cylinder 21 to retain the piston 22 in its fully retracted position. The source of air is then removed from the air inlet valve 27 and a cap 34 placed over the end of the valve 27 to prevent ingress of dirt. The compressed air cylinder 3 is then screwed into the holder 26. This constitutes the storage condition of the life jacket assembly which will be maintained until emergency inflation of the life jacket.

The diaphragm 7 continuously monitors the difference in pressure between the gas inside the life jacket and the ambient fluid. It will be appreciated that the stem 15 will move axially as the diaphragm 7 moves in response to changes in ambient fluid pressure. When the ambient fluid pressure exceeds the internal gas pressure by a predetermined amount, the stem 15 will bear on the lever 19, tilting the lever and thereby opening the whisker valve 18. The valve releases into the valve member housing 16 compressed air from manifold 20. As a result, air pressure within cylinder 21 rapidly falls, permitting the piston 22 to move rapidly forward under the bias of spring 24. This forward movement causes the pin 23 to pierce the operculum of the gas cylinder 3. Compressed gas thus released from the cylinder passes through gas outlet 28, outlet pipe 29 and outlet ports 32 to inflate the life jacket.

The diaphragm 7, stem 15 and lever 19 are arranged so that the control device is operated when immersed in about six inches of water. Differences of pressure when the life jacket is stored in atmospheric air or in the pressurised cabin of an aircraft are such that the stem will not bear upon the lever 19 and therefore the whisker valve 18 will remain closed.

The control device 2 provides a reliable means of automatically actuating inflation of the life jacket 1. The control device is much less susceptible to accidental operation than those control devices which rely upon the absorbtion of water by a water absorbent material. Further, the control device will prevent discharge of compressed gas into a life jacket which has already been manually inflated. In a manually inflated life jacket, the internal gas pressure will exceed the external fluid pressure even when the control device is immersed in several inches of water. Accordingly, the membrane 7 will be maintained in a position where the stem 15 does not bear on the lever 19 and the piston 22 thereby remains in its retracted position.

In a particular embodiment, a restriction may be provided in the air flowpath from the cylinder 21 upon activation of the device, to provide a time delay after actuation of lever 19 before inflation of the life jacket.

If desired, the lifejacket 1 can be inflated in response to manual actuation of the control device 2 by releasing compressed air from cylinder 21 either by opening valve 27 or depressing lever 19 using, for example, an elongate member inserted through bore 17. Appropriate manually operable mechanisms readily can be incorporated into the control device permitting of remote operation of said valve 27 or lever 19.

It will be appreciated that the invention is not restricted to the particular details described above and that numerous modifications and variations can be made without departing from the scope of the invention. In particular, the diaphragm 17 can be replaced by a cup diaphragm and the whisker valve 18 can be replaced by any convenient valve which will release the air pressure from cylinder 21 in response to movement of the stem 15. Further, the pipe 9 could open into an otherwise closed compartment of the lifejacket 1.

In an alternative embodiment to that described above, the control device senses pressure within a flexible reservoir such as a length of rubber or plastics tube, instead of within the inflatable article itself and actuates the inflation means when the ambient pressure exceeds by a predetermined amount the internal gas pressure within the reservoir. The reservoir can be located in or on the inflatable article.

In a further alternative embodiment, a weighted cap is provided for the housing 4, which when in position, presents activation of the device, and inflation of the life jacket. The cap is capable of being displaced by, for example, force caused by acceleration of the device, to permit normal operation. This is particularly advantageously when the life jacket is used by aircrew, to prevent premature inflation of the life jacket in the aircraft cockpit, whilst permitting normal operation after the acceleration caused by ejection from the cockpit, which causes the safety cap to be displaced.

I claim:

1. A device for automatically inflating an inflatable article on change of ambient pressure, the device including means for comparing the ambient fluid pressure with the pressure within a closed compartment, a container for a compressed gas for inflating the article, a piston slidably located in a cylinder and arranged to release compressed gas from the container to inflate the article on movement of the piston towards one end of the cylinder, means for resiliently biasing the piston towards the said end of the cylinder, an inlet valve to enable the cylinder to be pressurised to retain the piston against the said biasing means, and means responsive to the comparing means, to release pressure in the cylinder and thereby allow movement of the piston by the biasing means to release the compressed gas and inflate the article.

2. An inflatable article adapted for automatic inflation, including:

(a) means for inflating the article with a gas;

(b) means for comparing the ambient fluid pressure with the internal gas pressure in a closed compartment exposed to the ambient pressure, said compartment being made of a flexible material, whereby the pressure within said compartment is a function of the ambient pressure; and (c) means for activating the said inflation means automatically when the ambient fluid pressure exceeds by a predetermined amount the internal gas pressure in the said compartment.

3. An inflatable article adapted for automatic inflation, the article having:

(a) a closed internal space, said closed internal space being bounded by a flexible material, whereby the pressure within said closed internal space is a function of the ambient pressure;

(b) means for inflating the said space with a gas;

(c) means for comparing the ambient fluid pressure with the internal gas pressure in said space; and (d) means for activating the said inflation means automatically when the ambient fluid pressure exceeds by a predetermined amount the internal gas pressure in the said space.

4. An inflatable article adapted for automatic inflation, the article having a closed internal space, means for inflating the said space with a gas, a pressurizable chamber, means responsive to pressure in the pressurizable chamber to actuate the said inflation means on decrease of pressure in the chamber, means for comparing the ambient fluid pressure with the internal gas pressure in a closed flexible compartment, and means responsive to the said comparison means to release pressure in the pressurizable chamber and thereby activate the said inflation means automatically when the ambient fluid pressure exceeds by a predetermined amount the internal gas pressure in the said flexible compartment.

5. An article as claimed in claim 4, wherein the said closed flexible compartment is the said closed internal space of the inflatable article.

6. An article as claimed in claim 2, claim 3, or claim 4 wherein the inflatable article is a life jacket, an inflatable suit, or a life raft.

7. An article as claimed in claim 4 including an inlet valve for pressurizing the said pressurizable chamber.

8. An article as claimed in claim 4, wherein the said comparison means includes a diaphragm valve.

9. A control device for automatically actuating inflation means to inflate an inflatable article with gas, said control device comprising:

(a) pressure sensing means for monitoring the difference in pressure between the ambient fluid and gas within a closed compartment exposed to the ambient pressure and for providing a control signal when the ambient fluid pressure exceeds by a predetermined amount the gas pressure in the said compartment, said compartment being made of a flexible material, whereby the pressure within said compartment is a function of the ambient pressure, and (b) actuating means responsive to the said signal to actuate the inflation means.

10. A control device for automatically actuating inflation means to inflate an inflatable article with gas, said control device comprising a pressurizable chamber, means responsive to pressure in the chamber to activate the inflation means when pressure in the chamber falls below a predetermined level, pressure sensing means fo monitoring the difference in pressure between the ambient fluid and gas within a closed flexible compartment and triggering the release of pressure from the said chamber when the ambient fluid pressure exceeds by a predetermined amount the gas pressure in the said flexible compartment.

11. An inflatable article adapted for automatic inflation, said inflatable article including:

(a) a closed flexible compartment;

(b) means for inflating said closed flexible compartment with gas;

(c) means for comparing the ambient fluid pressure with the internal gas pressure in said closed flexible compartment; and (d) means for activating the said inflation means automatically when the ambient fluid pressure exceeds by a predetermined amount the internal gas pressure in said closed flexible compartment, said means comprising:

(i) a pressurizable cylinder;

(ii) means responsive to pressure in said pressurizable cylinder for activating said inflation means on decrease of pressure in said pressurizable cylinder; and (iii) means responsive to said comparison means for releasing pressure in said pressurizable cylinder.

12. An article as recited in claim 11 and further including an inlet valve for pressurizing said pressurizable cylinder.

13. An article as recited in claim 11 wherein said comparison means includes a diaphragm valve.

14. An article as recited in claim 11 wherein said inflation means comprises:

(a) a container containing a compressed gas and having an operculum seal and (b) means for puncturing said operculum seal on activation of said activation means.

15. A control device for automatically activating inflation means comprising a container containing a compressed gas and having an operculum seal and means for puncturing the operculum seal, thereby inflating an inflatable article with gas, said control device comprising:

(a) pressure sensing means for monitoring the difference in pressure between the ambient fluid and gas within a closed compartment exposed to the ambient pressure and for providing a control signal when the ambient fluid pressure exceeds by a predetermined amount the gas pressure in said closed compartment, said closed compartment being made of a flexible material, whereby the pressure within said compartment is a function of the ambient pressure, and (b) activating means responsive to said control signal for activating the inflation means.

* * * * *